US006577842B2

(12) United States Patent
Akiba et al.

(10) Patent No.: US 6,577,842 B2
(45) Date of Patent: Jun. 10, 2003

(54) IMAGE FORMING METHOD AND APPARATUS WITH TONER RECYCLING UNIT

(75) Inventors: Yasushi Akiba, Tokyo-to (JP); Fumihito Itoh, Tokyo-to (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/990,315

(22) Filed: Nov. 23, 2001

(65) Prior Publication Data

US 2002/0064408 A1 May 30, 2002

(30) Foreign Application Priority Data

Nov. 29, 2000 (JP) ..... 2000-363820
Oct. 23, 2001 (JP) ..... 2001-324641

(51) Int. Cl.[7] ..... G03G 21/10
(52) U.S. Cl. ..... 399/359; 399/253
(58) Field of Search ..... 399/149, 150, 399/253, 255, 256, 343, 358, 359, 360

(56) References Cited

U.S. PATENT DOCUMENTS 5,659,860 A 8/1997 Sasaki et al.
5,758,241 A 5/1998 Oyama et al.
5,771,429 A 6/1998 Oyama et al.
5,805,965 A 9/1998 Tsuda et al.
5,822,664 A 10/1998 Oka et al.
5,857,132 A 1/1999 Mizuishi et al.
5,983,059 A 11/1999 Oka et al.
6,091,912 A 7/2000 Kitajima et al.
6,151,471 A 11/2000 Yahata et al.
6,192,212 B1 * 2/2001 Kunihiro et al. ..... 399/253

FOREIGN PATENT DOCUMENTS

JP 06-175488 6/1994
JP 2000-132035 5/2000
JP 2000-172132 6/2000

* cited by examiner

*Primary Examiner*—Hoang Ngo
(74) *Attorney, Agent, or Firm*—Oblon, Spivak, McClelland, Maier & Neustadt, P.C.

(57) ABSTRACT

A method and apparatus for electrophotographic image forming are provided incorporating an improved toner recycling unit. This recycling unit is devised such that the selectable switching between toner recycling and non-recycling modes be continually carried out according to the decision based on the present amount of paper dusts measured by a paper dust measuring unit provided in a paper dust removal unit. The image forming apparatus incorporating the toner recycling unit is therefore capable of efficiently recycling the toner recovered from a cleaning unit without removing contaminants such as paper dusts and toner aggregates included in the recycled toner, thereby preventing the emergence of undesirable picture image anomalies such as whisker images and black dots.

20 Claims, 11 Drawing Sheets

IMAGE FORMING METHOD AND APPARATUS WITH TONER RECYCLING UNIT

BACKGROUND

1. Field

This patent specification relates generally to an image forming method and apparatus with toner recycling unit, and more specifically to the method and apparatus provided with improved toner recycling capability by means of selectively switching between recycling and non-recycling modes based on the results from toner measurements in recycled toner.

2. Discussion of the Background

The electrophotographic image forming process is well known. In image forming apparatuses such as a copying machine, printer and facsimile apparatus, in general, the formation of the images is carried out through the electrophotographic steps of forming electrostatic latent images on an image bearing member, developing as visible toner images using toner particles, and transferring the toner images by a transfer means onto a copy sheet, which subsequently passes through a fixing unit to form fixed images on the sheet.

Following transfer of the toner images onto the copy sheets, residual developing material remaining on the image bearing member (or photoreceptor drum) is generally removed by a cleaning device such as, for example, cleaning blade, and subsequently collected in a container tank for containing recovered toner material.

During the formation of images on the image bearing member such as photoreceptor drum and also toner transfer onto a copy sheet by means of the transfer means, residual toner will generally result onto the image bearing member primarily for the following reasons: The rate of toner transfer during transfer steps is not able to reach 100% and the background density between images can not be zero, either.

The residual toner, therefore, results in the dirty background in contrast to produced images on copy sheets. As mentioned above, the residual toner is subsequently collected in a container tank to be discarded afterward.

With increasing concern for resources and operation costs in recent years, recycling of the used toner material has been devised. For example, there disclosed in Japanese Laid-Open Patent Application No. 6-175488 is that used toner is collected and returned by a toner transporting unit to several units such as developing unit and toner supplying unit to be admixed with fresh toner material, and is subsequently reused for forming toner images on the image bearing member. The recent trend for toner recycling continue to increase in conventional image forming apparatuses.

In addition, it may be noted that the ratio of the amount of residual toner material to the total amount thereof generally used in conventional image forming apparatuses ranges approximately from 15% to 25%.

Several foreign materials or contaminants, which are exemplified by paper dusts and toner aggregates with its size larger than the desirable size, are often included in recycled toner in no small numbers. These materials may be utilized repeatedly during the recycling process in the toner recycling unit incorporated in image forming apparatus. As a result, several drawbacks are encountered in the image forming using the recycling unit, which are known as picture image anomalies such as blank spots and dark dots.

Although there provided in the aforementioned disclosure is a filter unit for removing paper dusts and toner aggregates, satisfactory devices and techniques therefor are yet to be devised.

As one of the above-mentioned picture image anomalies, whisker images are cited, which are formed being whisker-shaped against white background on a copy sheet, as illustrated in FIG. 13.

The whisker images are considered to be caused by paper dusts. Namely, the paper dusts are first originated from copy sheets, contained in recycled portion of the toner, and transported to the image bearing member when recycled. Along the recycling steps, therefore, the concentration of the paper dusts steadily increases in recycled toner component in the recycling path.

During subsequent developing step with toner particles, toner particles are adhered to the paper dusts, and then displaced altogether onto the image bearing member. As a result, the thus formed paper dusts accompanied by toner particles are subsequently transferred onto a copy sheet during the transfer step, then emerge as the whisker images especially visible against white background of the copy sheet.

It is noted that the steady increase in the content of paper dusts in recycled toner is considered due to the fact that the portion of the paper dusts, which is previously formed in the developing unit and included in the recycled toner, is generally removed by a copy sheet, to thereby return to the developer along the recycling, and this portion is added to that of paper dusts originated now from newly fed copy sheets.

In case when a transfer unit is used incorporating another device such as transfer belt or roller, residual toner is also formed in these devices. However, this portion of residual toner is not recycled in practice, since the amount thereof is small and its quality is relatively poor because of a larger content of paper dusts than that remaining on the image bearing member.

In addition, the present inventors investigated in detail on the generation of paper dusts by experimentation. They have found the amount of paper dusts, which is transported to the image bearing member by each copy sheet, varies considerably depending on the kind, or the quality of copy sheet.

For example, paper dusts are rarely found in the residual toner for copy sheets of fine quality even after feeding 300 k (i.e., 300 thousand) copy sheets, which is in contrast with a larger amount of the paper dusts for recycled or ordinary papers, in that more than 50 whisker images are sometimes recognized on an A4 size sheet after 300 k copy sheets.

In order to alleviate such difficulties, an appropriate device such as, for example, a classifier may preferably be provided for removing aggregated toner particles and paper dusts. This is exemplified by a mesh mounted in a toner recycling path, in which toner particles that pass through the mesh are put into a recycled use, while those left out are discarded. In such a classifier, however, difficulties still persist such as in clogging by the particles, durability of the mesh, and thorough removal of residual particle or dusts on the mesh. Therefore, improvements are yet to be made on this technique as well.

In known image forming apparatuses incorporating toner recycling units, therefore, several difficulties are encountered of appropriately removing undesirable contaminants to thereby prevent picture image anomalies such as whisker images and dark dots, as mentioned earlier.

In addition, since the amount of paper dusts and toner aggregates, which are included in the recycled toner, varies considerably depending on the kind of copy sheet and of toner in use as also indicated above, another method may be devised, in which the amount of the toner to be recycled out of the recovered toner is suitably adjusted depending on the above-mentioned amount of the contaminants which is presently obtained. That is, the ratio of the amount of recycled toner to that of recovered toner, or toner recycling rate, is adjusted so as to prevent picture anomalies.

However, since the amount of contaminants further varies depending on temperature and humidity as well, precise estimation and subsequent adjustments of the toner recycling rate has remained quite difficult in practice. This difficulty may therefore cause another problem, in that some of recovered toner may be wastefully discarded when the recycling system is operated with unduly low toner recycling rate.

SUMMARY

Accordingly, it is an object of the present disclosure to provide an image forming apparatus provided with an improved toner recycling unit, having most, if not all, of the advantages and features of similar employed units, while eliminating many of their disadvantages.

It is another object of the present disclosure to provide a toner recycling unit in the image forming apparatus capable of efficiently recycling the toner recovered from a cleaning unit, which is devised such that the selectable switching between the toner recycling and non-recycling modes be continually carried out according to the decision based on the present amount of paper dusts, thereby preventing the emergence of undesirable picture image anomalies.

The following brief description is a synopsis of only selected features and attributes of the present disclosure. A more complete description thereof is found below in the section entitled "Description of the Preferred Embodiments"

An image forming method is disclosed herein including at least the steps of forming an electrostatic latent image on an image bearing member, forming a toner image by developing the latent image using toner on the image bearing member, transferring the toner image to a substrate, and recovering the toner material remaining on the image bearing member following the transfer.

This image forming method is characterized by including the following additional steps such as computing an acceptable number of count of copy sheets that can be utilized in image forming in the forthcoming series of copying steps until immediately before the threshold for the emergence of picture image anomalies caused by contaminants in the toner in the toner recycling unit, based on a prescribed number of count of copy sheets that is experimentally obtained in advance, under a variety of mutually independent conditions, as the number of count of copy sheets that can be utilized in image forming for the period of time from the start of the recycled use of the toner until immediately before the threshold for the emergence of picture image anomalies caused by contaminants in the toner in the toner recycling unit, and on a cumulative sheet count which is accumulated in the present series of copying steps under running conditions as the number of count of copy sheets that is accumulated in the present series of copying steps after starting the recycled use of the toner, in which, if the acceptable number of count of copy sheets is equal to, or greater than an anticipated number of count of copy sheets that can be utilized in image forming in the forthcoming series of copying steps, the forthcoming series of copying steps are carried out in the toner recycling mode, while the acceptable number of count of copy sheets is less than an anticipated number of count of copy sheets that can be utilized in image forming in the forthcoming series of copying steps, the forthcoming series of copying steps are carried out in the toner non-recycling mode.

In addition, at the instant when the acceptable number of count of copy sheets is exceeded by the anticipated number of count of copy sheets, a toner discarding mode is implemented, in which all of the toner, that is recovered by the cleaning unit to be recycled into the developing unit, is discarded to a toner discarding tank.

Accordingly, it becomes feasible with the present method of image forming for the toner recovered by the cleaning unit be efficiently recycled without removing contaminants such as aggregated toner particles and paper dusts included in the recycled toner.

In addition, since contaminants of the amount unduly large, which may cause whisker images, can be excluded from the toner recycling path, the occurrence of undesirable picture image anomalies can be prevented.

According to another aspect, an image forming apparatus is disclosed including at least an image bearing member, an exposure unit for forming an electrostatic latent image on the image bearing member, a developing unit for forming a toner image by developing the latent image using toner on the image bearing member, a transfer unit for transferring the toner image to a substrate, a cleaning unit for cleaning the image bearing member by removing the toner material remaining on the image bearing member following the transfer, and a toner recycling unit for returning the toner removed from the image bearing member to the developing unit.

This image forming apparatus is characterized by including the following additional units such as a prescribed sheet count memory for storing a prescribed number of count of copy sheets that is experimentally obtained as the count that can be utilized in image forming for the period of time from the start of the recycled use of the toner until immediately before the threshold for the emergence of picture image anomalies caused by contaminants in the toner in the toner recycling unit, a cumulative sheet count memory for storing a cumulative number of count of copy sheets that is accumulated in the present series of copying steps after starting the recycled use of said toner, a computing unit for computing an acceptable number of count of copy sheets that can be utilized in image forming in the forthcoming series of copying steps until immediately before the threshold for the emergence of picture image anomalies caused by contaminants in the toner in the toner recycling unit, based on the acceptable number of count of copy sheets, and the prescribed number of count of copy sheets stored in the prescribed sheet count memory and a cumulative sheet count memory, respectively, and a selection unit for selectably switching between toner cycling mode and toner non-cycling mode for the image forming apparatus, based on the acceptable number of count of copy sheets computed by the computing unit.

In addition, this image forming apparatus may further includes a toner recycling path unit for transporting the toner removed from the image bearing member to the developing unit, a toner discarding path unit for transporting portions of the toner removed by the cleaning unit to a toner discarding tank, and a toner path switching unit for selectably switching between the toner recycling path unit and toner discarding path unit, based on the acceptable number of count of copy sheets computed by the computing unit, in which, at the instant when the acceptable number of count of copy sheets is exceeded by the anticipated number of count of copy sheets, the toner path switching unit is instructed to implement the toner discarding mode, in which all of the toner, that is recovered by the cleaning unit to be recycled into the developing unit, is discarded into a toner discarding tank.

It is noted that the prescribed number of count of copy sheets is the number experimentally obtained in advance, under a variety of mutually independent conditions, as the number of count of copy sheets which can be utilized in image forming for the period of time from the start of the recycled use of the toner until immediately before the threshold for the emergence of picture image anomalies caused by contaminants in the toner in the toner recycling unit, and that the cumulative sheet count is the number accumulated in the present series of copying steps under running conditions as the number of count of copy sheets which is accumulated in the present series of copying steps after starting the recycled use of said toner, in which the computing unit is adapted to compute the acceptable number of count of copy sheets which can be utilized in image forming in the forthcoming series of copying steps under running conditions until immediately before the threshold for the emergence of picture image anomalies caused by contaminants in the toner in the toner recycling unit.

Accordingly, it becomes feasible with the present construction of the image forming apparatus for the toner recovered by the cleaning unit be efficiently recycled without removing contaminants such as aggregated toner particles and paper dusts included in the recycled toner, to thereby the emergence of undesirable picture image anomalies be effectively prevented.

According to still another aspect, an image forming apparatus is disclosed including at least an image bearing member, an exposure unit for forming an electrostatic latent image on the image bearing member, a developing unit for forming a toner image by developing the latent image using toner on the image bearing member, a transfer unit for transferring the toner image to a substrate, a cleaning unit for cleaning the image bearing member by removing the toner material remaining on the image bearing member following the transfer, and a toner recycling unit for returning the toner removed from the image bearing member to the developing unit.

This image forming apparatus is characterized by including the following additional units such as

- a paper dust measuring unit provided in a paper dust removal unit for measuring the amount of paper dusts collected in the paper dust removal unit, which are adhered to, and subsequently removed from, feeding rolls,
- a dust amount estimating unit for estimating the amount of paper dusts included in the toner recovered by the cleaning unit based on the results from the estimation by the dust amount estimating unit, and
- a computing unit for computing the acceptable number of count of copy sheets that can be utilized in image forming in the forthcoming series of copying steps for the period of time from start of the recycled use of the toner until immediately before the threshold for the emergence of picture image anomalies caused by contaminants in the toner in the toner recycling unit, based on the results on the amount of paper dusts from the estimation by the dust amount estimating unit, and
- a selection unit for selectably switching between toner cycling mode and toner non-cycling mode for the image forming apparatus, based on the acceptable number of count of copy sheets computed by the computing unit.

Accordingly, it becomes feasible with the present construction of the image forming apparatus for the toner recovered by the cleaning unit be efficiently recycled without removing contaminants such as paper dusts and toner aggregates included in the recycled toner, thereby eliminating undesirable picture image anomalies.

The present disclosure and features and advantages thereof will be more readily apparent from the following detailed description and appended claims when taken with drawings.

DESCRIPTION OF THE PREFERRED EMBODIMENTS

In the detailed description which follows, specific embodiments on a toner recycling unit included in an image forming apparatus are described. It is understood, however, that the present disclosure is not limited to these embodiments, and it is appreciated that the unit and method for recycling toner disclosed herein may also be adaptable to any form of materials recycling. Other embodiments will be apparent to those skilled in the art upon reading the following description.

Figure 1:
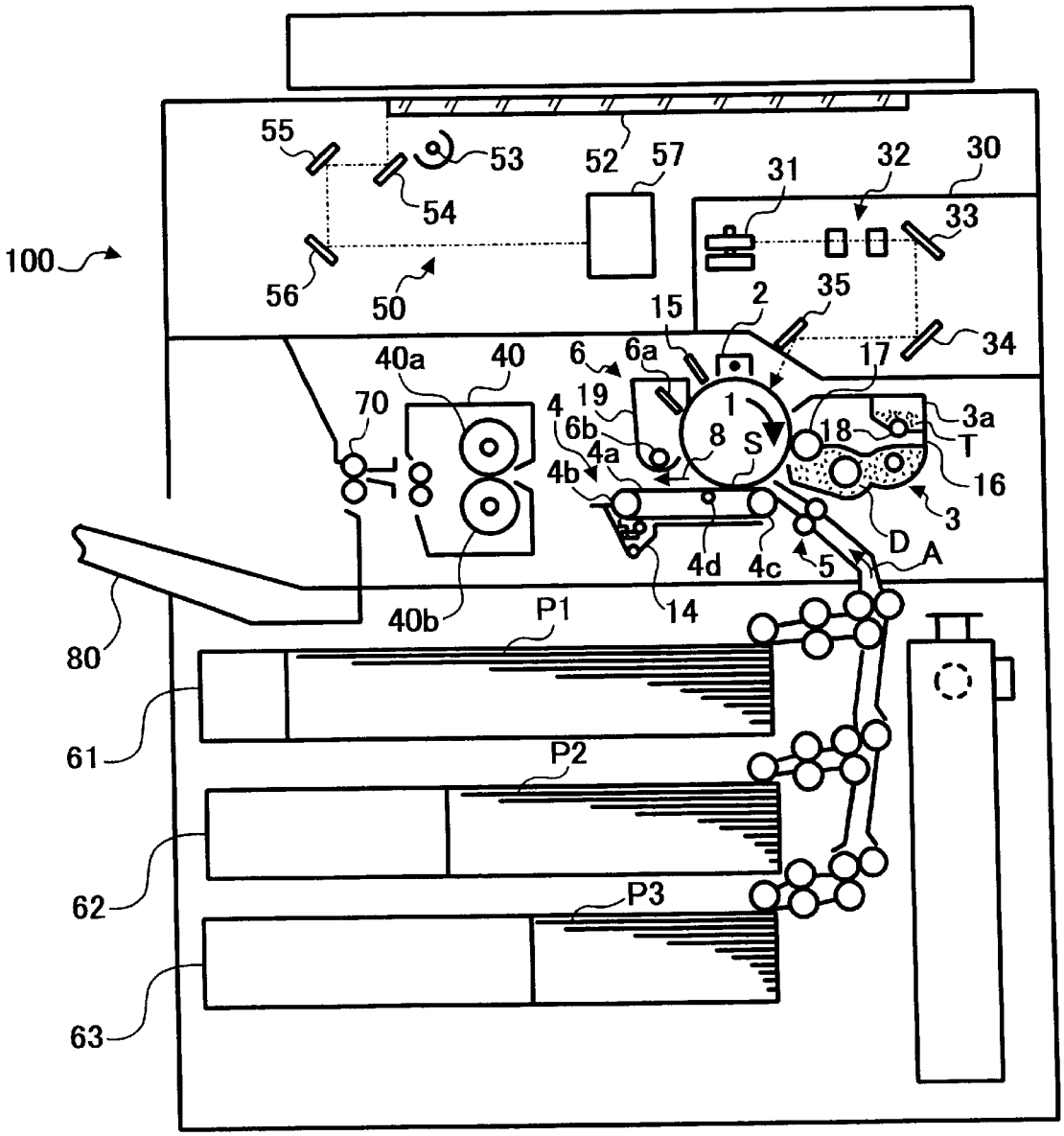
FIG. 1 is a schematic diagram of a side view of the copying machine as image forming apparatus according to one embodiment disclosed herein.

FIG. 1 is a schematic diagram of a side view of the copying machine as image forming system according to one embodiment disclosed herein. The copying machine here is provided with the capabilities such as the electrophotographic image reproduction and printing. Also, the machine may additionally provided with the capability as a facsimile unit.

Referring to FIG. 1, the copying machine includes at least a photoreceptor drum 1 as image bearing member, a charging device 2 for uniformly charging the surface of the photoreceptor 1, an exposure unit 30 for forming an electrostatic latent image on the charged surface of the photoreceptor drum 1, a developing unit 3 for forming toner images using developing agents D on the photoreceptor 1, a transfer unit 4 for transferring the developed toner image to a copy sheet P1 (and P2, P3), a fixing unit 40 for fixing the transferred toner image onto the copy sheet P1 (and P2, P3), and a cleaning unit 6 for cleaning the surface of the photoreceptor 1 by removing residual toner material following the transfer.

As illustrated in FIG. 1, a document reading unit 50 is provided in the upper portion of main console 100 of the copying machine. A document or image document (not shown) to be copied is placed on a transparent contact glass 52 of the document reading unit 50 and illuminated with a light source 53 designed as to be displaced toward the right in FIG. 1.

Being formed by the reflected light, the image of the document is reflected by a multi mirror scanning optics system and then leads to an image pickup device 57. A multi-mirror scanning optics system here includes a first mirror 53 movable in coincident with the light source 53 and a pair of half rate movable mirrors 55, 56. The optics system with the cooperating movable scanning mirrors is a type well known.

The image pickup device 57 is provided with an image sensor such as, for example, a CCD device (not shown) for inputting the reflected document image and a focusing lens (not shown) for focusing the image onto the sensor. The image signals thus input to image pickup device 57 are subsequently transmitted to the exposure unit 30.

The exposure unit 30 includes at least a rotating polygonal mirror 31 for deflecting laser beams L emitted from a laser source (not shown), and mirrors 33, 34, 35 for reflecting the laser beams L which are led through a lens system 32 including an F-θ lens for forming scanning images.

Subsequently, by exposing the surface of the photoreceptor drum 1 with laser beams modulated by the image signals previously input to the image pickup device 57, an electrostatic latent image of the document is formed.

The thus formed electrostatic latent image on the surface of the photoreceptor 1 is then rendered visible by the developing unit 3 through the application of developing material.

The developing unit 3 illustrated in FIG. 1 includes a developer case 16 containing a developing agent D and a developing roller 17 rotatively supported therewithin. Onto the periphery of the developing roll 17, the developing agent D is transported to be utilized for forming visual images for the latent image.

Although a two-component powder developer, which consists of toner and carrier, is used as the developing agent D for the developing unit 3 in the present embodiment, a single- or mono-component developer consisting of toner alone may also be used alternatively.

In addition, the developer case 16 is provided with a toner hopper 3*a* in which the toner T is disposed. When the concentration of the toner in developing agent D in the developer case 16 decreases, the portion of toner T in the toner hopper 3*a* is supplied by a rotating toner supply roll 18 to the developer case 16 to be admixed with the developing agent D.

As to copy sheets, ones selected from any of plural stacks of the sheets P1, P2 and P3 respectively placed in sheet feeding cassettes 61, 62 and 63 are fed along the direction of arrow A in FIG. 1 (by way of the present example, the cassette P1 is selected). The copy sheet P1 is then forwarded to the transfer unit 4 in proper registration by a registration pinch roll pair 5.

The transfer unit 4 includes a transfer belt 4*a* which is suspended winding around a driving roll 4*b*, supporting drive roll 4*c* and biasing roll 4*d* as illustrated in FIG. 1.

The transfer belt 4*a* is formed of such material as to have a medium range of electric resistivity in its surface region, and provided for the movement along the arrow B in FIG. 1 around the above-mentioned rolls 4*b*, 4*c* and 4*d*, to be brought into contact with the surface of photoreceptor drum 1 at point S for achieving the image transfer.

In addition, the belt 4*a* is also provided such that, on the copy sheet P1 be forwarded past the point S, an electric voltage having the polarity opposite to that of the toner is applied from a high voltage source (not shown) to the sheet P1 by way of the biasing roll 4*d*.

When this reversed biases voltage is applied to biasing roll 4*d*, a current flow is caused therefrom to the driving roll 4*b* and supporting drive roll 4*c* through the transfer belt 4*a*, and further to the photoreceptor drum 1 through the copy sheet P1. In addition, the magnitude of the applied voltage is adjusted such that the current through the photoreceptor drum 1 stays at a predetermined level suitable for the transfer current.

Further, the charge generated on the transfer belt 4*a* by the biasing roll 4*d* during the voltage impression is subsequently discharged by the driving roll 4*b*.

The movement of the copy sheet P1, which is sent out by the registration pinch roll pair 5 and transported along the transfer belt 4*a*, is designed to be in proper registration with the toner images on the photoreceptor drum 1 on passing the aforementioned point S for the image transfer.

On passing the point S the toner image on the surface of the photoreceptor drum 1 is brought in contact with the copy sheet P1 under the aforementioned voltage, which has the polarity opposite to that of the toner and being applied thereon through the biasing roll 4*d* provided on the other side of the transfer belt 4*a*. As a result, the toner image on the photoreceptor drum 1 is electrostatically transferred to the contacting side of the copy sheet P1.

Following transfer of the image, the copy sheet P1, which is forwarded further along, and then separated from, the transfer belt 4*a*, is subsequently advanced to the fixing unit 40.

The fixing unit 40 includes at least a heated fusing roll pair 40*a*, 40*b* forming a nip between which the copy sheet P1 passes, wherein the transferred toner image on the sheet P1 permanently fixed.

After fixing the toner image, the copy sheet P1 is advanced to exit nip roll pair 70 from where it may be directed to a collecting tray 80.

After transfer some residual toner invariably remains on the photoreceptor drum 1. The residual toner remaining on the surface of the photoreceptor drum 1 is removed by the cleaning unit 6.

The cleaning unit 6 includes at least a cleaning case 19, cleaning blade 6*a* housed within, and disposing screw 6*b* provided in the bottom of the cleaning unit 6 for disposing the toner. The cleaning blade 6*a* suitably formed of elastic material such as rubber, for example, is provided along the axial direction of the photoreceptor drum 1 over the region in which the toner image is formed (i.e., the residual toner may remain). In addition, one side of the blade 6*a* is fixed onto the wall of the cleaning case 19, while the other side thereof is brought in scraping contact with the outer periphery of the photoreceptor drum 1, to thereby be suitably adapted to remove the residual toner.

After cleaning the surface the charge remaining on the surface of the photoreceptor drum 1 is dissipated by a discharging unit 15 consisting of an appropriate lamp. The photoreceptor drum 1 is thereby initialized in preparation for the next copying cycle.

Thereafter, the entire sequence of the copying process steps is repeated starting with the charging step by the charging unit 2 to produce another copy of the document or image document.

It is noted some portions of the toner adhere to a certain extent onto the surface of transfer belt 4*a* as well, which is caused during the transfer from the photoreceptor drum 1. Since this toner portion may adhere to the reversed side of the copy sheet P1, if left as is, thereby causing undesirable stains on the sheet. The toner adhered to the transfer belt 4*a* is therefore appropriately removed by a belt cleaning unit 14.

Figure 2:
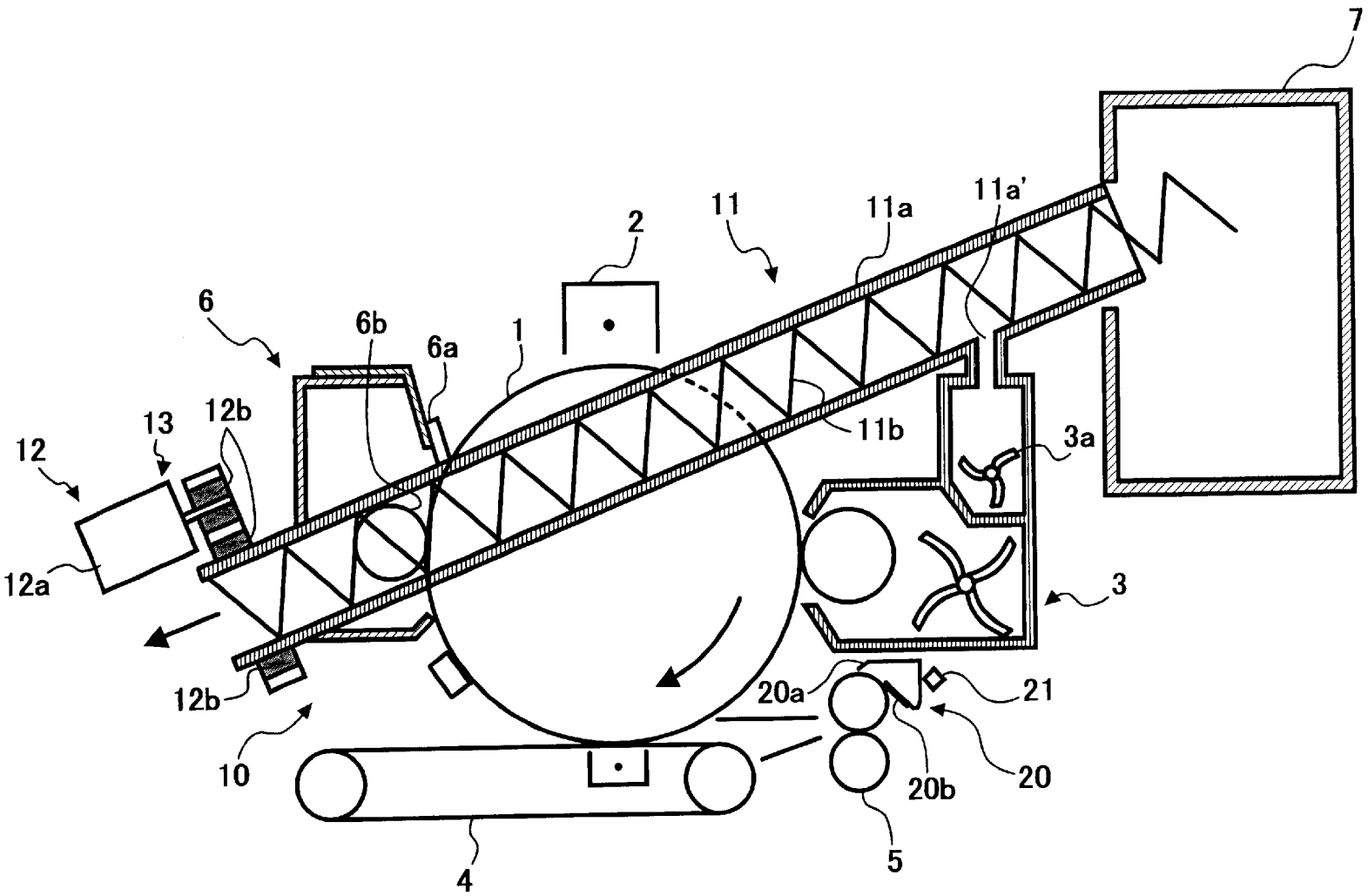
FIG. 2 is a schematic diagram of a side view of the toner recycling unit provided in the image forming apparatus according to one embodiment disclosed herein.

FIG. 2 is a schematic diagram of a side view of the toner recycling unit provided in the image forming apparatus according to one embodiment disclosed herein.

Referring to FIG. 2, the toner recycling unit will be described hereinbelow. As indicated earlier, the cleaning unit 6 is adapted to remove by scraping the residual toner material while in contact with the surface of the image bearing member. The thus removed residual toner is then transported by a transporting screw 6*b* in the direction normal to the face of the drawing FIG. 1, to subsequently be lead to a toner recycling unit 10.

The toner recycling unit 10 includes at least a toner transporting means 11 for selectively transporting the toner material recovered from the cleaning unit 6 to either the developing unit 3 or a toner recovery container 7, and a driving means 12 for driving the toner transporting means 11.

The toner transporting means 11 includes at least a transporting pipe 11*a* provided rotatively along the axis thereof extending in an ascending manner from the position capable of receiving the recovered toner transported by a toner transporting screw 6*b* to the toner recovery container 7 by way of the developing unit 3, and a transporting screw 11*b* provided rotatively in the transporting pipe 11*a* for raising the toner along in the axis direction by rotating the screw 11*a*.

The driving means 12 includes a transporting pipe driver 12 including a motor 12*a* for rotating the transporting pipe 11*a* around the axis thereof in a predetermined direction of the rotation and a gear 12*b* to be engaged with the motor 12*a*, and a motor (not shown) for rotating the transporting screw 11*b*.

The transporting pipe 11*a* is devised to have an opening 11*a*' situated at the location connectable to an opposing opening provided on the side of a toner hopper 3*a* of the developing unit 3.

As a result, when the opening 11*a*' is positioned to direct downward as shown in FIG. 1, the toner in the transporting pipe 11*a* disposed downward into the toner hopper 3*a* through the adjoining openings, to thereby be rendered to the recycling use (hereinafter referred to as recycling mode). In contrast, when the transporting pipe 11*a* rotates so as the opening 11*a*' to be positioned directing upward as shown in FIG. 3, the toner stay in the transporting pipe 11*a* to further be transported to the recovery container 7 to be subsequently discarded (non-recycling mode).

The selection of the toner recycling and non-recycling modes therefore becomes feasible, and the selection or switching between the modes can be carried out, for example, by a selection switch (not shown) provided in an operation unit.

Figure 3:
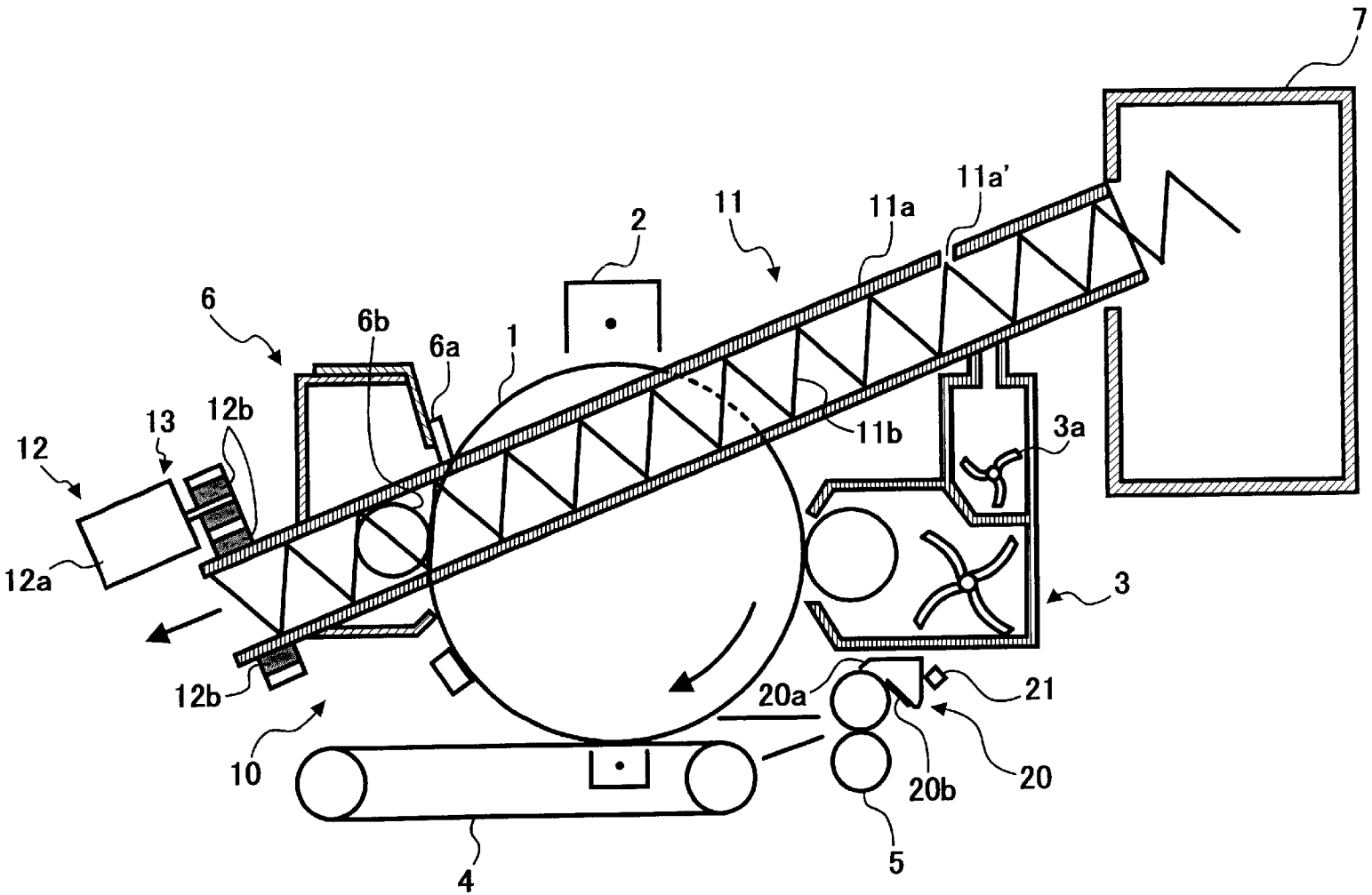
FIG. 3 is a schematic diagram of a side view of the toner recycling unit provided in the image forming apparatus according to another embodiment disclosed herein.

Namely, in order to carry out appropriate switching steps, the angle of rotation around the axis of the transporting pipe 11*a* is adjusted such that the opening 11*a*' selectively directs either downward as shown in FIG. 1 (for toner recycling mode) or upward as shown in FIG. 3 (for non-recycling mode). This is achieved in practice by devising for control signals be output to the transporting pipe driver 12 from a control unit including a CPU (not shown) for suitably carrying out the switching steps.

The toner recycling unit disclosed herein is characterized by providing a mechanism to determine the timing of switching between the toner recycling and non-recycling modes, which is implemented by measuring the amount, and rate of generation, of paper dusts by a paper dust removal unit 20.

That is, on feeding a copy sheet into the position appropriate to image transfer in the developing unit, a register unit 5 consisting of a registration roll pair is adapted to coincide the position of a copy sheet with that of toner image on the image bearing member 1. This is achieved with the registration roll pair by bringing the copy sheet temporarily on hold and then forwarded to the proper copying position.

It should be noted that, during paper handling and feeding steps on the upstream of registration rolls, copy papers are subjected to the friction with several rolls in the feeding path and tend to generate paper dusts with relative ease. To prevent the paper dusts from entering into the area of the image bearing member as much as possible, the paper dust removal unit 20 is provided in contact with at least one of the registration rolls.

Accordingly, the paper dust removal unit 20 is devised to include at least a casing 20*a* for receiving paper dusts, a blade 20*b* for scraping paper dusts off from the surface of the registration roll, and a photosensor 20*c* for detecting the amount of paper dusts deposited.

The photosensor 20*c* consists of, for example, an optical device of paired transmission type light emitter and detector. A plurality of the photosensors are provided facing one another on opposing inner faces of the casing 20*a*, to be utilized for detecting the level of the paper dust. Detected signals output from the photosensors are transmitted to, and subsequently processed by, a control unit (not shown).

The paper dust removal unit 20 has been found effective to some extent for preventing paper dusts from the image bearing member. For example, there prevented by the removal unit are image anomalies such as toner deficient streaks caused by the failure in cleaning, that is, by paper dusts clogged between the cleaning blade and image bearing member.

Utilizing the toner recycling unit 20 described above, the timing of switching between the toner recycling and non-recycling modes can be determined for the image forming apparatus disclosed herein. This is achieved with the photosensor 20*c* incorporated into the recycling unit 20 by measuring the amount, and rate of generation, of paper dusts in the casing 20*a*. To be more specific, starting from the time zero of clearing the casing 20*a* when the dust amount is also zero, the amount of paper dusts deposited in the casing 20*a* is measured over the period of time when a predetermined number of copied is made.

From the amount of the dust measured and the count of copies made, it is feasible to determine, among others, the kind or nature of the copy sheets currently used such as generating more dusts or having larger sizes with less amount of the dusts. Based on these measurements it becomes also feasible to determine the timing of switching between the toner recycling and non-recycling modes.

As a result, toner recycling including undue amount of paper dusts can be alleviated, since the switching between the toner recycling and non-recycling modes can be properly carried out based on the amount of the paper dusts actually measured.

Figure 4:
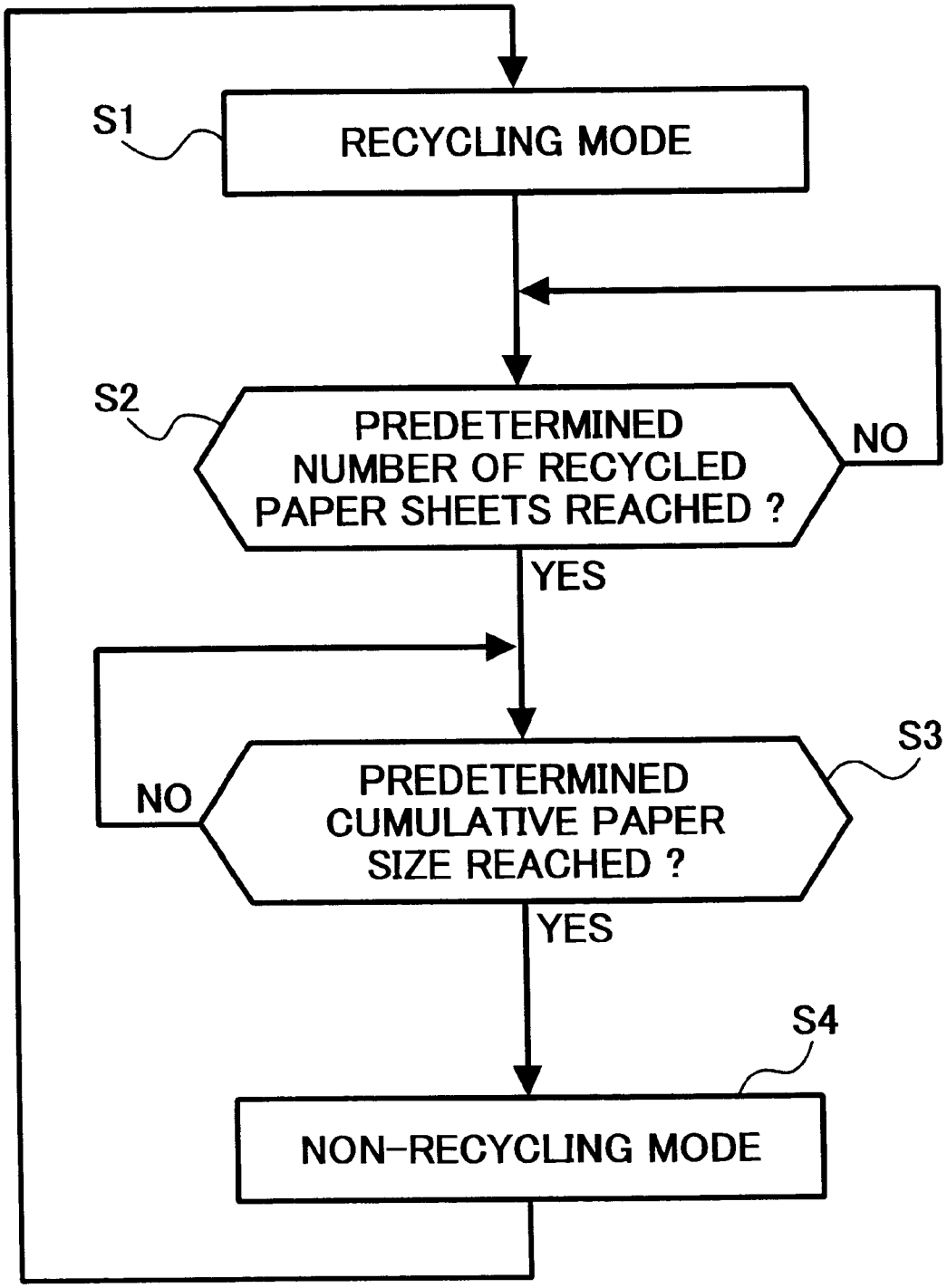
FIG. 4 includes a flow chart illustrating a process flow for determining the timing of switching the modes from toner recycling to non-recycling according to one embodiment disclosed herein.

FIG. 4 includes a flow chart illustrating a process flow for determining the timing of switching modes from toner recycling to non-recycling according to one embodiment disclosed herein.

Referring to FIG. 4, the process begins in Step 1 where a new toner recycling mode is initiated by rotating the transporting pipe 11*a* around the axis thereof such that the opening 11*a*' directs downward as shown in FIG. 1.

The process then proceeds to Step 2, where measurements are carried out to obtain the number count of current copy sheets which tend to generate more dusts (e.g., recycled paper sheets) currently fed. If the number count reaches a predetermined value (YES, in Step 2), the addition of the paper size is calculated for all the copies made from the time when recycling mode is initiated. The result obtained from the calculation, or hereinafter referred to as cumulative paper size, is subsequently stored into the control unit.

In Step 3, an inquiry is made regarding whether the thus obtained cumulative paper size reach a predetermined value stored in advance. If the answer is affirmative (YES), the process proceeds to switch to the non-recycling mode.

As to the determination of number count of current copy sheets in Step 2, the count can be secured by providing a sheet supply unit having with the following construction. For example, the sheet supply unit has a plurality of shelves, each carrying a different kind of copy sheets such as recycled, high quality ones, etc. Further, by presetting the shelves each to respective kinds of the papers and by counting the number of papers supplied by respective shelves, the count of copy sheets can be obtained.

With this construction of the sheet supply unit, the number count of copy sheets actually supplied during the Steps 1 and 2 can be determined more accurately. Accordingly, it can be determined in Step 2 whether the number count reaches the predetermined value based on the number determined as above.

The above-mentioned predetermined value, or hereinafter referred to as prescribed sheet count, may be preset based on the results from the experiments which are carried out in advance with conventional copy sheets to obtain the frequency, and the rate of the occurrence of whisker images.

Figure 5:
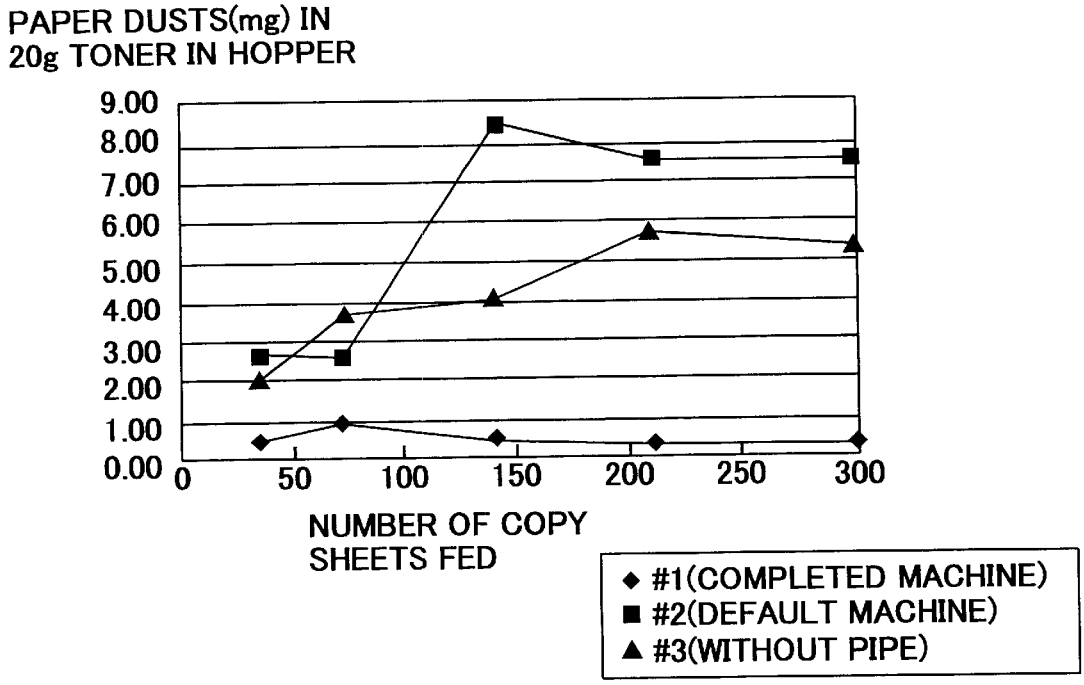
FIG. 5 contains a graph showing the change in the amount of paper dusts included in the toner in the toner hopper with the number of copy sheets fed during the experimentation.
Figure 6:
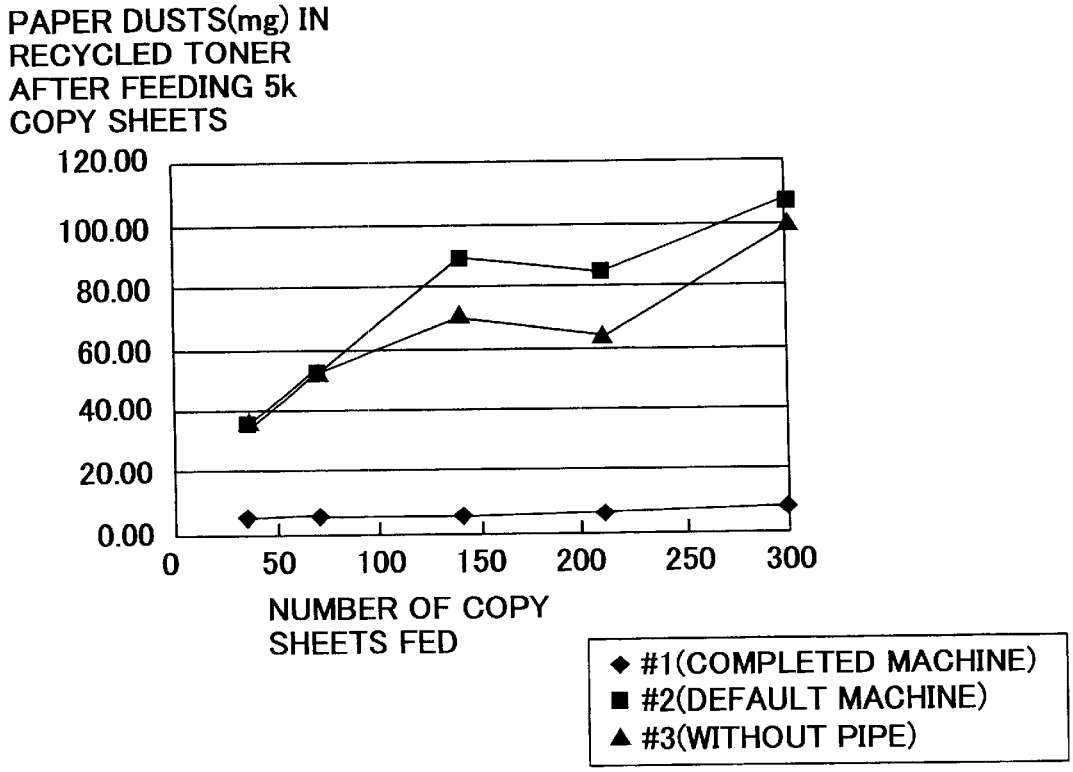
FIG. 6 contains a graph showing the change in the amount of paper dusts included in the toner in the recycled toner with the number of copy sheets fed during the experimentation.

The experiments were carried out by the present inventors, and the following results were obtained as illustrated in FIGS. 5 and 6. Namely, FIG. 5 contains a graph showing the change in the amount of paper dusts included in the toner in toner hopper 3*a* with number of copy sheets fed during the experimentation. Similarly, FIG. 6 contains a graph showing the change in the amount of paper dusts included in the toner in the recycled toner with number of copy sheets fed.

It should be noted that the preset value may deviate from the current, actual value depending on detailed running conditions. This deviation may be reduced by incorporating additional capability of variably setting the predetermined value into the sheet supply and control units. The predetermined value may therefore be made adjustable with this capability depending not only on specific requirements on the whisker images by respective users, but also on more detailed control of the amount of toner consumption taking the occurrence of whisker image into consideration together with the change in environmental conditions or the use of special copy sheets.

As to the cumulative sheet count aforementioned in Step 3, its value may be obtained from the experiments and stored into the control unit as the predetermined value. In addition, the predetermined value may also be made adjustable depending on more detailed running conditions and the emergence of whisker images.

The period of time for implementing the toner non-recycling mode is determined based on the period for the toner materials be transported along the transporting path including through the transporting pipe 11*a* and into toner recovery container 7, which is a function of the overall length of the path and the velocity of the transport.

The period of the non-recycling mode can therefore be obtained in general from the experiments and stored into the control unit as the predetermined value, to subsequently be utilized for implementing the non-recycling mode. In addition, the period may also be made adjustable depending on more detailed running conditions.

Figure 7:
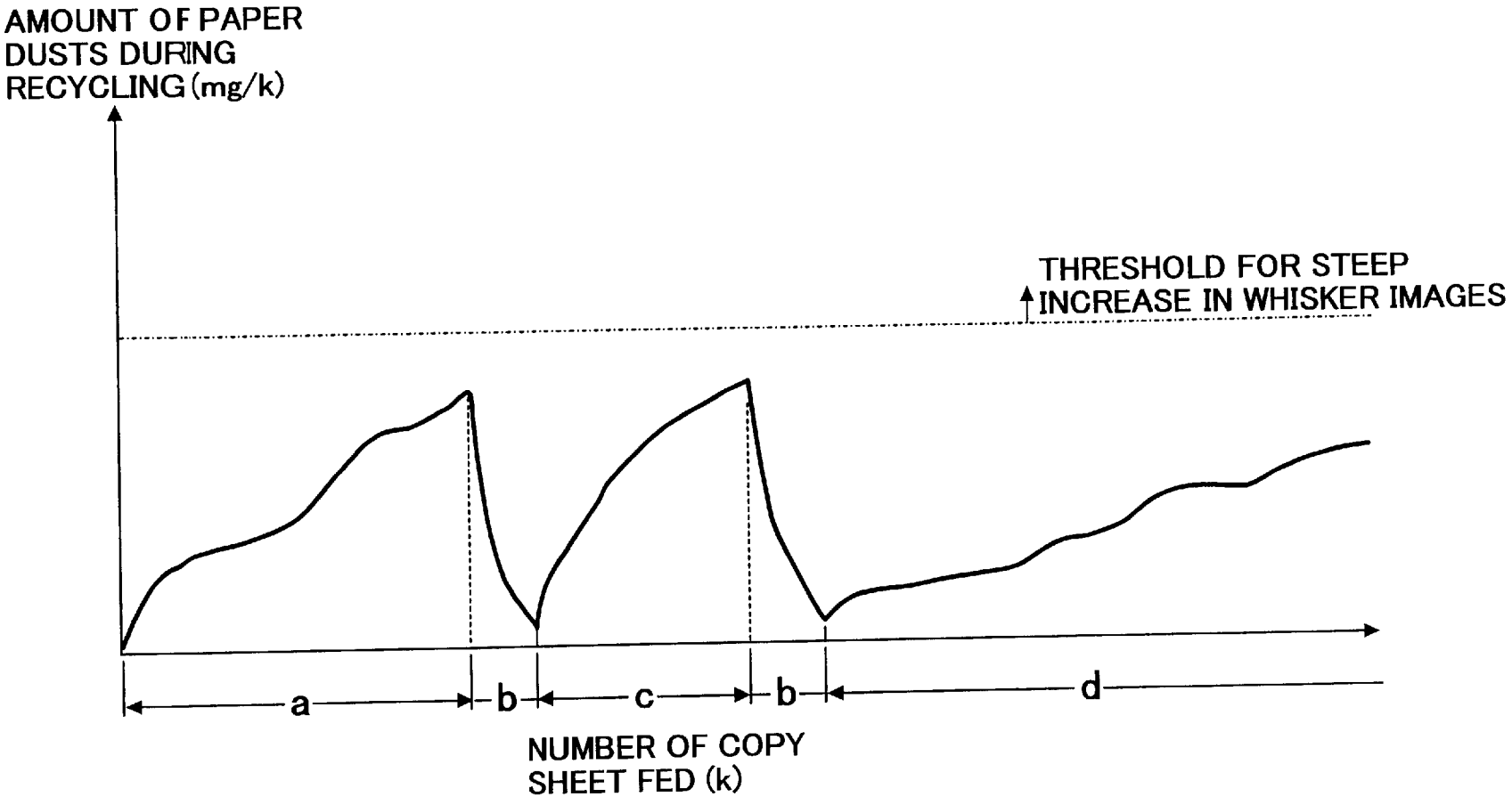
FIG. 7 contains a graph showing the change in the amount of paper dusts included in the toner with number of copy sheets fed through the mode switching between toner recycling and non-recycling, in which the graph portions a, c and d correspond to the recycling periods, while the plural portions b correspond to non-recycling period.

FIG. 7 contains a graph showing the change in the amount of paper dusts included in toner with number of copy sheets fed through the mode switching between the toner recycling and non-recycling, in which the graph portions a, c and d correspond to the recycling periods, while the plural portions b correspond to non-recycling period.

Clearly shown in FIG. 7 is the difference in the pattern of the changes in the dust amount in the toner. Namely, a wavy increase in the graph portion 'a' when copy sheets of several different kinds and sizes are used, a rapid and exponential increase in 'c' portion when only one kind of, but dusty paper sheets are used, and a relatively slow and steady increase in 'd' portion when less dusty papers are used.

Figure 8:
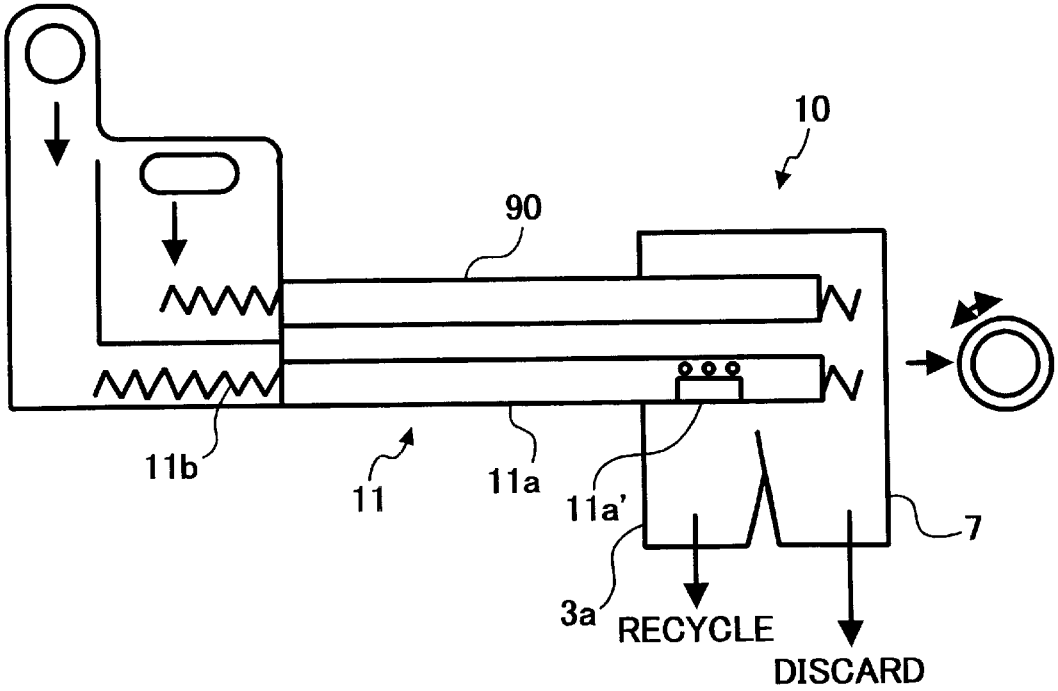
FIG. 8 is a schematic diagram of a side view of the toner recycling unit according to other embodiment disclosed herein.
Figure 9:
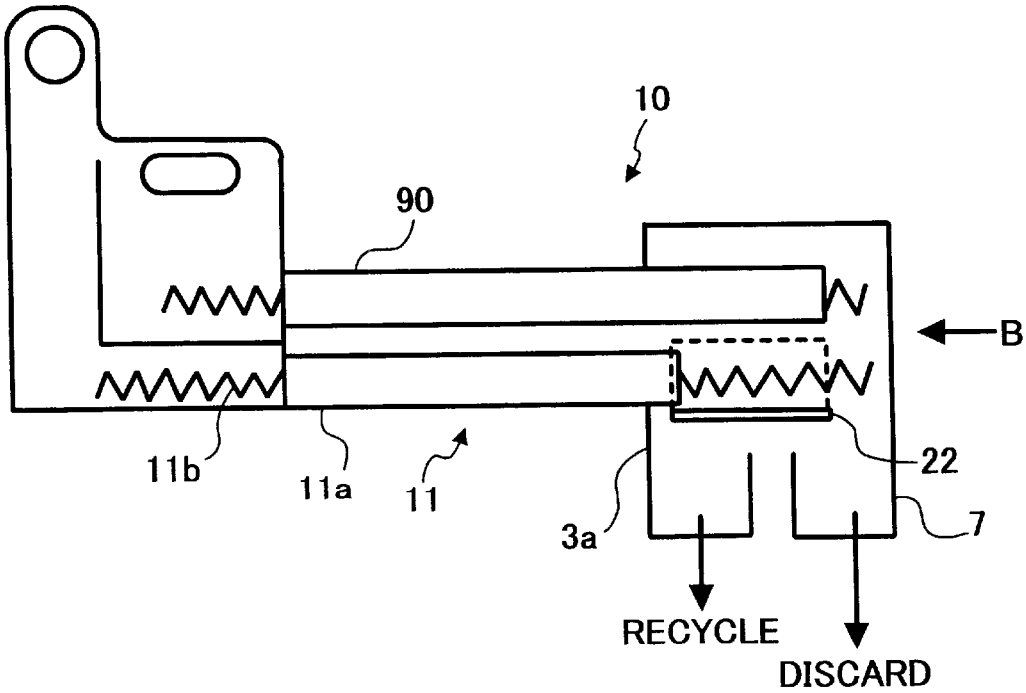
FIG. 9 is a schematic diagram of a side view of the toner recycling unit according to another embodiment disclosed herein.

FIGS. 8 and 9 are schematic diagrams of side views of the toner recycling unit 10 provided in the image forming apparatus according to further embodiments disclosed herein.

The toner recycling unit 10 is provided with at least one toner transporting path in which the toner material, which recovered from photoreceptor drum 1 by cleaning unit 6 and transported by the disposing screw 6*b*, is transported either to the toner hopper 3*a* or the toner disposal container 7, and the other transporting path in which the residual toner, which is removed by the belt cleaning unit 14 from the transfer belt 4*a*, is transported to the toner recovery container 7.

In addition, the selection of the toner recycling and non-recycling modes is devised to be appropriately carried out by a shutter 22 provided in conjunction with the opening portion 11*a*' of transporting pipe 11*a* as shown in FIG. 9. The shutter 22 here is mounted being pivotably supported by a spindle 23 as shown in FIG. 10 and can be rotated by a solenoid 24 around the spindle axis.

Figure 10:
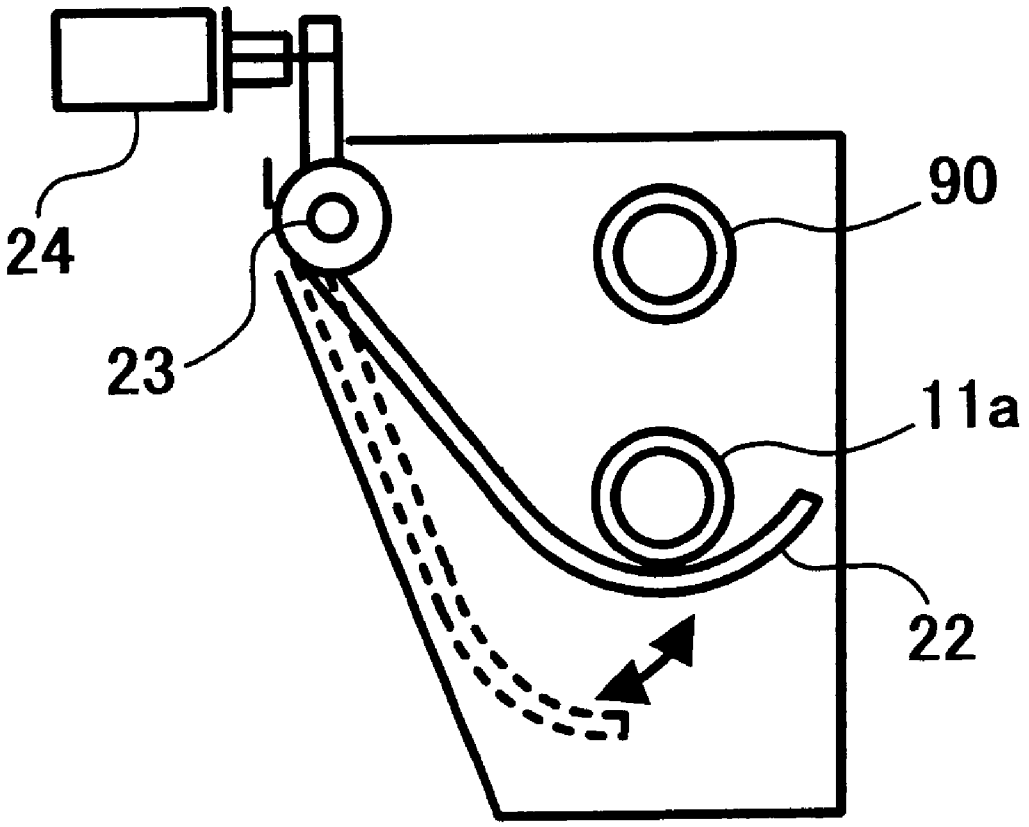
FIG. 10 is a schematic view of the shutter device taken from the direction of the arrow B of FIG. 9.

With the present construction and in the operating configuration of the shutter 22 indicated by the solid lines in FIG. 10, the toner material recovered from photoreceptor drum 1 is transported to the toner disposal container 7 in the non-recycling mode. In contrast, the recovered toner in the recycling mode is transported to the toner hopper 3*a* with the shutter in the operating configuration (or in the retreated position) indicated by the broken lines.

Figure 11:
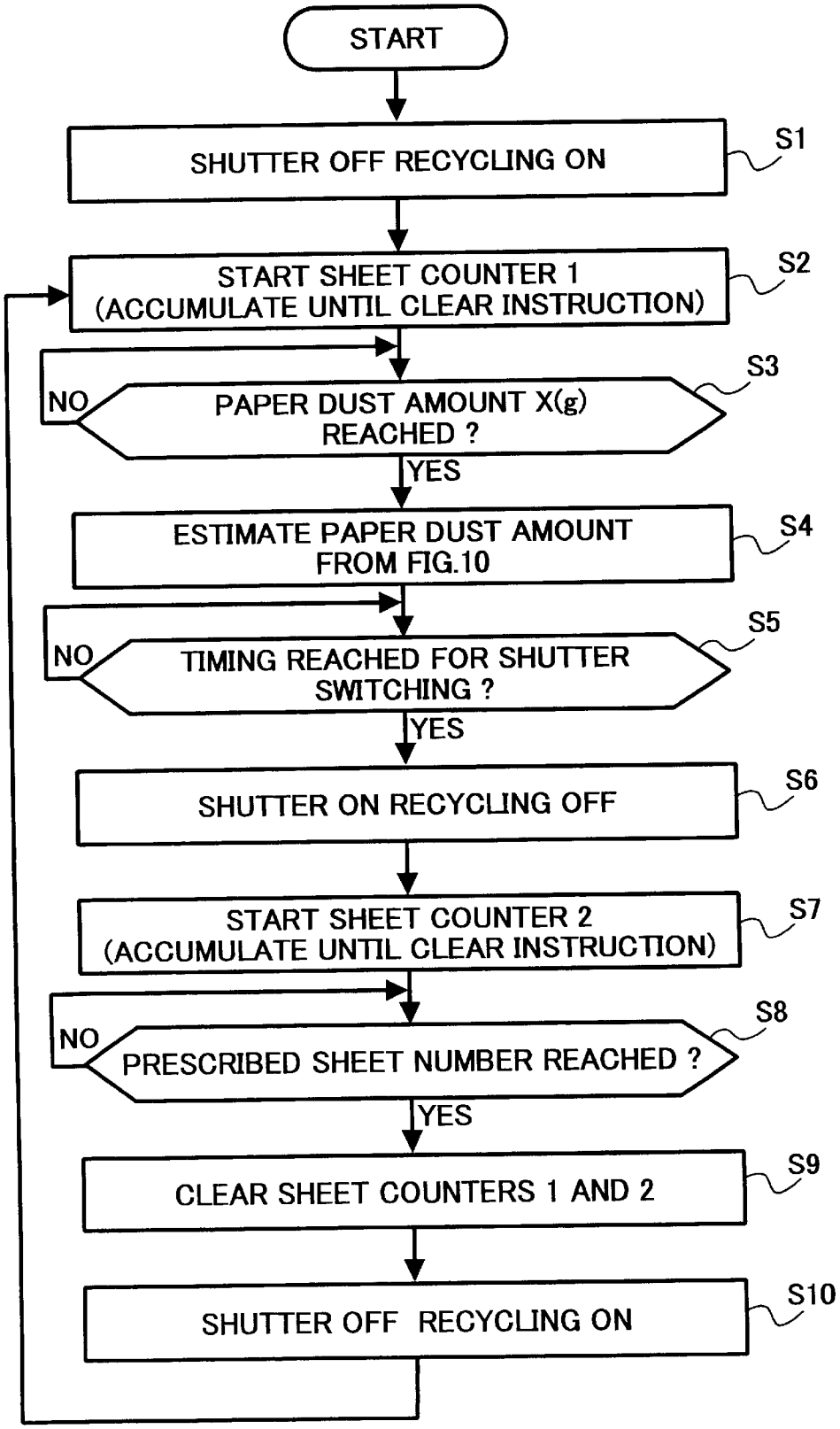
FIG. 11 includes a flow chart illustrating a process flow for controlling the switching mode from toner recycling to non-recycling according to another embodiment disclosed herein.

FIG. 11 includes a flow chart illustrating a process flow for controlling the switching mode from toner recycling to non-recycling according to another embodiment disclosed herein.

In the present method for controlling the switching mode, several parameters and the relation therebetween necessary for the control are obtained in advance from the experiments. One of the parameters is the number of copy sheets fed up to the instant when amount of the paper dusts is reached to that characteristic for the emergence of the whisker images, x(in gram), corresponding to the aforementioned predetermined value of the paper dusts. Another number of copy sheets is then obtained as that fed up to the instant when the shutter 22 is switched to the recycling mode.

Figure 12:
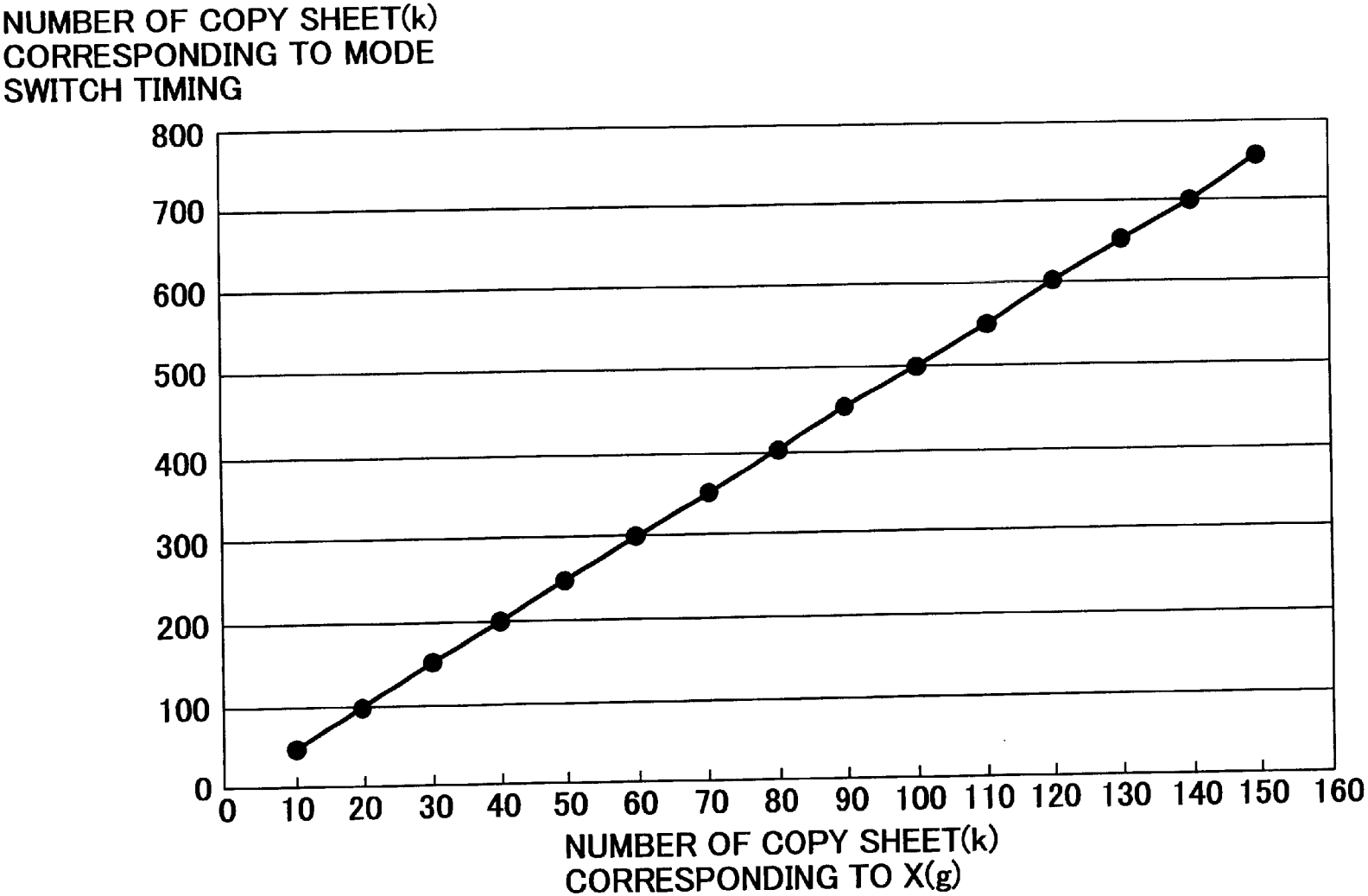
FIG. 12 includes a graphical plot of experimental results with the number of copy sheets fed until the instant when the shutter is switched to the recycling mode, vertically, versus the number when the amount of the paper dusts is reached to that characteristic for the emergence of the whisker images, horizontally.
Figure 13:
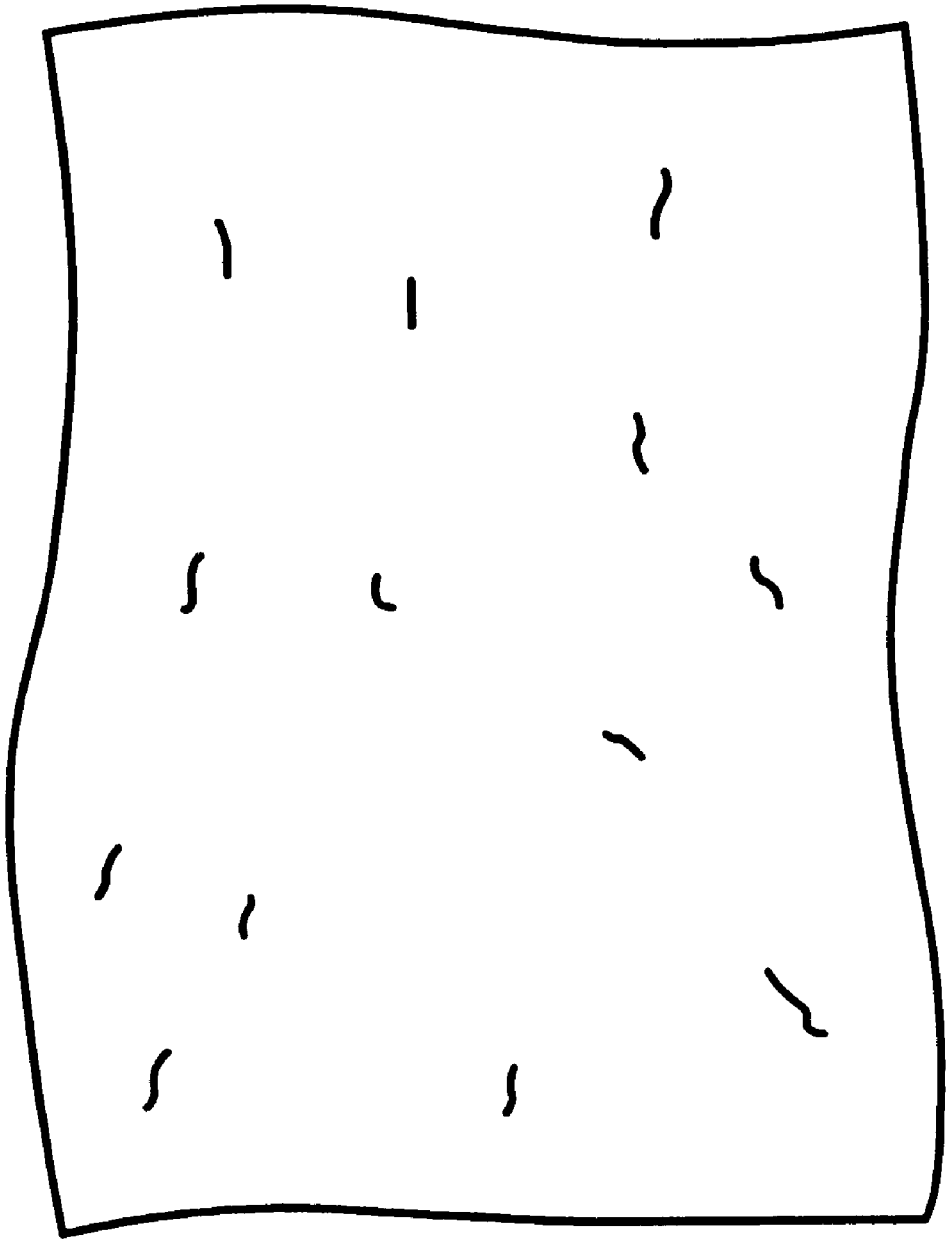
FIG. 13 illustrates whisker images formed against white background on a copy sheet.

Subsequently, also from experiment, the relation between these two sheet numbers is obtained. The results from the experiment are shown in FIG. 12 which plots the latter sheet number, vertically, versus the former sheet number, horizontally.

Referring again to FIG. 11, the process steps for controlling the switching mode from of toner recycling to non-recycling are carried out as follows.

The process begins in Step 1 where the shutter 22 is turned OFF (in the aforementioned retreated position) and a new toner recycling mode is initiated (ON). The process then proceeds to Step 2, where the number count for copy sheets fed in the recycling mode is made. In Step 3, an inquiry is made regarding whether the amount of paper dusts recovered from the registration roll reaches the predetermined value of x(g).

Subsequently in Step 4, based on the answer to the inquiry and the graphical plot in FIG. 12, the amount of paper dusts in recycled toner is estimated. In Step 5, another inquiry is then made regarding whether the thus estimated paper dust value reaches the level for switching the shutter 22. If the answer is affirmative (YES), the process proceeds to Step 6 to switch the shutter ON to turn off the recycling mode and to initiate the non-recycling mode. Next in Step 7, the number count for copy sheets fed in the non-recycling mode is made.

In Step 8, still another inquiry is made regarding whether the thus made number count reaches a predetermined value which is defined by the number of copy sheets to be fed during the period of time in which the toner be transported through the entire path of the recycling unit 10. The predetermined value is therefore a function of the path length for the toner recycling. If the answer is affirmative (YES), the process proceeds to Step 9 to clear several counts made in the above steps, and subsequently to Step 10 to switch the shutter OFF, or to turn the recycling mode on.

Since the capability of switching between the toner recycling and non-recycling modes is provided in the image forming apparatus disclosed herein, process steps suitable for forming the images can be carried out to meet the changes in paper dust actually measured as mentioned above.

That is, by appropriately switching between the toner recycling and non-recycling modes based on the amount of paper dusts experimentally obtained, undesirable toner transport to the developing unit 3 can be alleviated, which includes excess amounts of paper dust to cause the aforementioned picture image anomaly such as whisker images.

Although the paper dusts are primarily described with respect to the excess amounts thereof in the present embodiments, the measurements may be made also on toner aggregates, to thereby effect the switching between the recycling and non-recycling modes based on the results from the toner aggregate measurements, as well.

The apparatuses and process steps set forth in the present description may therefore be implemented using suitable host computers and terminals incorporating appropriate processors programmed according to the teachings disclosed herein, as will be appreciated to those skilled in the relevant arts.

Therefore, the present disclosure also includes a computer-based product which may be hosted on a storage medium and include instructions which can be used to program a processor to perform a process in accordance with the present disclosure. The storage medium can include, but is not limited to, any type of disk including floppy disks, optical disks, CD-ROMS, magneto-optical disks, ROMs, RAMs, EPROMs, EEPROMS, flash memory, magnetic or optical cards, or any type of media suitable for storing electronic instructions.

It is apparent from the above description including the examples, the methods and apparatuses disclosed herein for forming electrophotographic images have several advantages over similar methods previously known.

That is, the image forming apparatus disclosed herein incorporate an improved toner recycling unit. This recycling unit is devised such that the selection between the toner recycling and non-recycling modes be continually carried out according to the decision based on the present amount of paper dusts measured by the paper dust measuring unit provided in the paper dust removal unit.

The present image forming apparatus incorporating the toner recycling unit is therefore capable of efficiently recycling the toner recovered from the cleaning unit without removing contaminants such as paper dusts and toner aggregates included in the recycled toner, to thereby be able to prevent the emergence of undesirable picture image anomalies such as whisker images and black dots.

Obviously, additional modifications and variations of the present invention are possible in light of the above teachings. It is therefore to be understood that within the scope of the appended claims, the invention may be practiced otherwise than as specifically described herein.

This document claims priority and contains subject matter related to Japanese Patent Applications No. 2000-363820 and 2001-324641, filed with the Japanese Patent Office on Nov. 29, 2000 and Oct. 23, 2001, respectively, the entire contents of which are hereby incorporated by reference.

What is claimed as new and desired to be secured by letters patent of the United States is:

1. An image forming method including at least the steps of forming an electrostatic latent image on an image bearing member, forming a toner image by developing said latent image using toner on said image bearing member, transferring said toner image to a substrate, and recovering said toner remaining on said image bearing member following the transfer, comprising the step of:

computing an acceptable number of count of copy sheets that can be utilized in image forming in a forthcoming series of copying steps until immediately before a threshold for the emergence of picture image anomalies caused by contaminants in said toner in said toner recycling unit, based on a prescribed number of count of copy sheets that is experimentally obtained in advance, under a variety of mutually independent conditions, as a number of count of copy sheets that can be utilized in image forming for a period of time from start of a recycled use of said toner until immediately before a threshold for the emergence of picture image anomalies caused by contaminants in said toner in said toner recycling unit, and on a cumulative sheet count which is accumulated, in a present series of copying steps under running conditions, as a number of count of copy sheets that is accumulated in said present series of copying steps after starting a recycled use of said toner;

wherein, if said acceptable number of count of copy sheets is equal to, or greater than an anticipated number of count of copy sheets that can be utilized in image forming in a forthcoming series of copying steps, said forthcoming series of copying steps are carried out in said toner recycling mode, and wherein, if said acceptable number of count of copy sheets is less than an anticipated number of count of copy sheets that can be utilized in image forming in a forthcoming series of copying steps, said forthcoming series of copying steps are carried out in said toner non-recycling mode.

2. The method according to claim 1, wherein, at an instant when said acceptable count number of copy sheets is exceeded by said anticipated count number of copy sheets, a toner discarding mode is implemented, in which all of said toner that is recovered by said cleaning unit to be recycled into said developing unit is discarded into a toner discarding tank.

3. An image forming apparatus for use with at least an image bearing member, an exposure unit configured to form an electrostatic latent image on said image bearing member, a developing unit configured to form a toner image by developing said latent image using toner on said image bearing member, a transfer unit configured to transfer said toner image to a substrate, a cleaning unit configured to clean said image bearing member by removing said toner material remaining on said image bearing member following the transfer, and a toner recycling unit configured to return said toner removed from said image bearing member to said developing unit, comprising:

a prescribed sheet count memory configured to store a prescribed count number of copy sheets that is experimentally obtained as a count that can be utilized in image forming for a period of time from a start of a recycled use of said toner until immediately before a threshold for emergence of picture image anomalies caused by contaminants in said toner in said toner recycling unit;

a cumulative sheet count memory configured to store a cumulative count number of copy sheets that is accumulated in a present series of copying operations after starting the recycled use of said toner;

a computing unit configured to compute an acceptable count number of copy sheets that can be utilized in image forming in a forthcoming series of copying operations under running conditions until immediately before said threshold for the emergence of picture image anomalies caused by contaminants in said toner in said toner recycling unit, based on said acceptable count number of copy sheets, and said prescribed count number of copy sheets, stored in said prescribed sheet count memory and cumulative sheet count memory, respectively; and a selection unit configured to selectably switch between a toner recycling mode and a toner non-recycling mode for said image forming apparatus, based on said acceptable count number of copy sheets computed by said computing unit.

4. The image forming apparatus according to claim 3, further comprising:

a toner recycling path unit for transporting said toner removed from said image bearing member to said developing unit;

a toner discarding path unit for transporting portions of said toner removed by said cleaning unit to a toner discarding tank; and a toner path switching unit for selectably switching between said toner recycling path unit and toner discarding path unit, based on said acceptable number of count of copy sheets computed by said computing unit, wherein, at an instant when said acceptable number of count of copy sheets is exceeded by an anticipated number of count of copy sheets, said toner path switching unit is instructed to implement said toner discarding mode, in which all of said toner, that is recovered by said cleaning unit to be recycled into said developing unit, is discarded into a toner discarding tank.

5. The image forming apparatus according to claim 3, wherein said prescribed count number of copy sheets is a number experimentally obtained in advance as said count number of copy sheets that can be utilized in image forming for a period of time from the start of said recycled use of said toner until immediately before said threshold for the emergence of picture image anomalies caused by contaminants in said toner in said toner recycling unit, said cumulative sheet count being a number accumulated in said present series of copying operations under running conditions as said count number of copy sheets that is accumulated in said present series of copying operations after starting said recycled use of said toner, wherein said computing unit is configured to compute said acceptable count number of copy sheets that can be utilized in image forming in a forthcoming series of copying operations under running conditions until immediately before said threshold for the emergence of picture image anomalies caused by contaminants in said toner in said toner recycling unit.

6. An image forming apparatus for use with at least an image bearing member, an exposure unit configured to form an electrostatic latent image on said image bearing member, a developing unit configured to form a toner image by developing said latent image using toner on said image bearing member, a transfer unit for transferring said toner image to a substrate, a cleaning unit configured to clean said image bearing member by removing said toner material remaining on said image bearing member following the transfer, and a toner recycling unit configured to return said toner removed from said image bearing member to said developing unit, comprising:

a paper dust measuring unit provided in a paper dust removal unit and configured to measure an amount of paper dust collected in said paper dust removal unit;

a dust amount estimating unit configured to estimate an amount of paper dust included in said toner recovered by said cleaning unit based on results from an estimation; and a computing unit configured to compute an acceptable count number of copy sheets that can be utilized in image forming in a forthcoming series of copying operations for a period of time from a start of a recycled use of said toner until immediately before a threshold for emergence of picture image anomalies caused by contaminants in said toner in said toner recycling unit, based on said results on the estimated amount of paper dust by said dust amount estimating unit; and a selection unit configured to selectably switch between a toner recycling mode and a toner non-recycling mode for said image forming apparatus, based on said acceptable count number of copy sheets computed by said computing unit.

7. An image forming means for use with at least image bearing means, exposure means for forming an electrostatic latent image on said image bearing means, developing means for forming a toner image by developing said latent image using toner on said image bearing means, transfer means for transferring said toner image to a substrate, cleaning means for cleaning said image bearing means by removing said toner remaining on said image bearing means following the transfer, and toner recycling means for returning said toner removed from said image bearing means to said developing means, comprising:

prescribed sheet count memory means for storing a prescribed count number of copy sheets that is experimentally obtained as a count that can be utilized in image forming for a period of time from a start of a recycled use of said toner until immediately before a threshold for emergence of picture image anomalies caused by contaminants in said toner in said toner recycling means;

cumulative sheet count memory means for storing a cumulative count number of copy sheets that is accumulated in a present series of copying operations after starting a recycled use of said toner;

computing means for computing an acceptable count number of copy sheets that can be utilized in image forming in a forthcoming series of copying operations under running conditions until immediately before said threshold for the emergence of picture image anomalies caused by contaminants in said toner in said toner recycling means, based on said acceptable count number of copy sheets, and said prescribed count number of copy sheets, stored in said prescribed sheet count memory means and a cumulative sheet count memory means, respectively; and selection means for selectably switching between a toner recycling mode and a toner non-recycling mode for said image forming means, based on said acceptable count number of copy sheets computed by said computing means.

8. The image forming means according to claim 7, further comprising:

toner recycling path means for transporting said toner removed from said image bearing means to said developing means;

toner discarding path means for transporting portions of said toner removed by said cleaning means to a toner discarding tank means; and toner path switching means for selectably switching between said toner recycling path means and toner discarding path means, based on said acceptable number of count of copy sheets computed by said computing means, wherein, at an instant when said acceptable number of count of copy sheets is exceeded by an anticipated number of count of copy sheets, said toner path switching means is instructed to implement said toner discarding mode, in which all of said toner, that is recovered by said cleaning means to be recycled into said developing means, is discarded into a toner discarding tank means.

9. The image forming means according to claim 7, wherein said prescribed count number of copy sheets is a number experimentally obtained in advance as said count number of copy sheets that can be utilized in image forming for a period of time from a start of said recycled use of said toner until immediately before said threshold for the emergence of picture image anomalies caused by contaminants in said toner in said toner recycling means, said cumulative sheet count being a number accumulated in said present series of copying operations under running conditions as said count number of copy sheets that is accumulated in said present series of copying operations after starting said recycled use of said toner, wherein said computing means is adapted to compute said acceptable count number of copy sheets that can be utilized in image forming in a forthcoming series of copying operation under running conditions until immediately before said threshold for the emergence of picture image anomalies caused by contaminants in said toner in said toner recycling means.

10. An image forming means for use with at least image bearing means, exposure means for forming an electrostatic latent image on said image bearing means, developing means for forming a toner image by developing said latent image using toner on said image bearing means, transfer means for transferring said toner image to a substrate, cleaning means for cleaning said image bearing means by removing said toner material remaining on said image bearing means following the transfer, and toner recycling means for returning said toner removed from said image bearing means to said developing means, further comprising:

paper dust measuring means provided in a paper dust removal means for measuring an amount of paper dust collected in said paper dust removal means;

dust amount estimating means for estimating an amount of paper dust included in said toner recovered by said cleaning means based on an estimation;

computing means for computing an acceptable count number of copy sheets that can be utilized in image forming in a forthcoming series of copying operations for a period of time from a start of a recycled use of said toner until immediately before a threshold for emergence of picture image anomalies caused by contaminants in said toner in said toner recycling means, based on results on the estimated amount of paper dust by said dust amount estimating means; and selection means for selectably switching between a toner recycling mode and toner non-recycling mode for said image forming means, based on said acceptable count number of copy sheets computed by said computing means.

11. An image forming method comprising:

forming an electrostatic latent image on an image bearing member;

forming a toner image by developing said latent image using toner on said image bearing member;

transferring said toner image to a substrate;

recovering said toner remaining on said image bearing member following the transfer; and computing an acceptable count number of copy sheets that can be utilized in image forming in a forthcoming series of copying operations until immediately before a threshold for emergence of picture image anomalies caused by contaminants in said toner in said toner recycling unit, based on a prescribed count number of copy sheets that is experimentally obtained in advance as a count number of copy sheets that can be utilized in forming for a period of time from a start of a recycled use of said toner until immediately before said threshold for the emergence of picture image anomalies caused by contaminants in said toner in said toner recycling unit, and on a cumulative sheet count accumulated, in a present series of copying operations under running conditions, as a count number of copy sheets that is accumulated in said present series of copying operations after starting the recycled use of said toner;

wherein, if said acceptable count number of copy sheets is equal to or greater than an anticipated count number of copy sheets that can be utilized in image forming in said forthcoming series of copying operations, said forthcoming series of copying operations are carried out in a toner recycling mode, and wherein, if said acceptable count number of copy sheets is less than said anticipated count number of copy sheets that can be utilized in image forming in said forthcoming series of copying operations, said forthcoming series of copying operations are carried out in a toner non-recycling mode.

12. The method according to claim 11, wherein, at an instant when said acceptable count number of copy sheets is exceeded by said anticipated count number of copy sheets, a toner discarding mode is implemented, in which all of said toner that is recovered by said cleaning unit to be recycled into said developing unit is discarded into a toner discarding tank.

13. An image forming apparatus comprising:

at least an image bearing member;

an exposure unit configured to form an electrostatic latent image on said image bearing member;

a developing unit configured to form a toner image by developing said latent image using toner on said image bearing member;

a transfer unit configured to transfer said toner image to a substrate;

a cleaning unit configured to clean said image bearing member by removing said toner material remaining on said image bearing member following the transfer;

a toner recycling unit configured to return said toner removed from said image bearing member to said developing unit;

a prescribed sheet count memory configured to store a prescribed count number of copy sheets that is experimentally obtained as a count that can be utilized in image forming for a period of time from a start of a recycled use of said toner until immediately before a threshold for emergence of picture image anomalies caused by contaminants in said toner in said toner recycling unit;

a cumulative sheet count memory configured to store a cumulative count number of copy sheets that is accumulated in a present series of copying operations after starting the recycled use of said toner;

a computing unit configured to compute an acceptable count number of copy sheets that can be utilized in image forming in a forthcoming series of copying operations under running conditions until immediately before said threshold for the emergence of picture image anomalies caused by contaminants in said toner in said toner recycling unit, based on said acceptable count number of copy sheets, and said prescribed count number of copy sheets, stored in said prescribed sheet count memory and cumulative sheet count memory, respectively; and a selection unit configured to selectably switch between a toner recycling mode and a toner non-recycling mode for said image forming apparatus, based on said acceptable count number of copy sheets computed by said computing unit.

14. The image forming apparatus according to claim 13, further comprising:

a toner recycling path unit configured to transport said toner removed from said image bearing member to said developing unit;

a toner discarding path unit configured to transport portions of said toner removed by said cleaning unit to a toner discarding tank; and a toner path switching unit configured to selectably switch between said toner recycling path unit and toner discarding path unit, based on said acceptable count number of copy sheets computed by said computing unit, wherein, when said acceptable count number of copy sheets is exceeded by an anticipated count number of copy sheets, said toner path switching unit is configured to implement said toner discarding mode, in which all of said toner that is recovered by said cleaning unit to be recycled into said developing unit is discarded into a toner discarding tank.

15. The image forming apparatus according to claim 13, wherein said prescribed count number of copy sheets is a number experimentally obtained in advance as said count number of copy sheets that can be utilized in image forming for a period of time from the start of said recycled use of said toner until immediately before said threshold for the emergence of picture image anomalies caused by contaminants in said toner in said toner recycling unit, said cumulative sheet count being a number accumulated in said present series of copying operations under running conditions as said count number of copy sheets that is accumulated in said present series of copying operations after starting said recycled use of said toner, wherein said computing unit is configured to compute said acceptable count number of copy sheets that can be utilized in image forming in a forthcoming series of copying operations under running conditions until immediately before said threshold for the emergence of picture image anomalies caused by contaminants in said toner in said toner recycling unit.

16. An image forming apparatus comprising:

at least an image bearing member;

an exposure unit configured to form an electrostatic latent image on said image bearing member;

a developing unit configured to form a toner image by developing said latent image using toner on said image bearing member;

a transfer unit for transferring said toner image to a substrate;

a cleaning unit configured to clean said image bearing member by removing said toner material remaining on said image bearing member following the transfer;

a toner recycling unit configured to return said toner removed from said image bearing member to said developing unit;

a paper dust measuring unit provided in a paper dust removal unit and configured to measure an amount of paper dust collected in said paper dust removal unit;

a dust amount estimating unit configured to estimate an amount of paper dust included in said toner recovered by said cleaning unit based on results from an estimation; and a computing unit configured to compute an acceptable count number of copy sheets that can be utilized in image forming in a forthcoming series of copying operations for a period of time from a start of a recycled use of said toner until immediately before a threshold for emergence of picture image anomalies caused by contaminants in said toner in said toner recycling unit, based on said results on the estimated amount of paper dust by said dust amount estimating unit; and a selection unit configured to selectably switch between a toner recycling mode and a toner non-recycling mode for said image forming apparatus, based on said acceptable count number of copy sheets computed by said computing unit.

17. An image forming means comprising:

at least image bearing means, exposure means for forming an electrostatic latent image on said image bearing means;

developing means for forming a toner image by developing said latent image using toner on said image bearing means;

transfer means for transferring said toner image to a substrate;

cleaning means for cleaning said image bearing means by removing said toner remaining on said image bearing means following the transfer;

toner recycling means for returning said toner removed from said image bearing means to said developing means;

prescribed sheet count memory means for storing a prescribed count number of copy sheets that is experimentally obtained as a count that can be utilized in image forming for a period of time from a start of a recycled use of said toner until immediately before a threshold for emergence of picture image anomalies caused by contaminants in said toner in said toner recycling means;

cumulative sheet count memory means for storing a cumulative count number of copy sheets that is accumulated in a present series of copying operations after starting a recycled use of said toner;

computing means for computing an acceptable count number of copy sheets that can be utilized in image forming in a forthcoming series of copying operations under running conditions until immediately before said threshold for the emergence of picture image anomalies caused by contaminants in said toner in said toner recycling means, based on said acceptable count number of copy sheets, and said prescribed count number of copy sheets, stored in said prescribed sheet count memory means and a cumulative sheet count memory means, respectively; and selection means for selectably switching between a toner recycling mode and a toner non-recycling mode for said image forming means, based on said acceptable count number of copy sheets computed by said computing means.

18. The image forming means according to claim 17, further comprising:

toner recycling path means for transporting said toner removed from said image bearing means to said developing means;

toner discarding path means for transporting portions of said toner removed by said cleaning means to a toner discarding tank means; and toner path switching means for selectably switching between said toner recycling path means and toner discarding path means, based on said acceptable count number of copy sheets computed by said computing means, wherein, when said acceptable count number of copy sheets is exceeded by an anticipated count number of copy sheets, said toner path switching means is controlled to implement said toner discarding mode, in which all of said toner that is recovered by said cleaning means to be recycled into said developing means is discarded into a toner discarding tank means.

19. The image forming means according to claim 17, wherein said prescribed count number of copy sheets is a number experimentally obtained in advance as said count number of copy sheets that can be utilized in image forming for a period of time from a start of said recycled use of said toner until immediately before said threshold for the emergence of picture image anomalies caused by contaminants in said toner in said toner recycling means, said cumulative sheet count being a number accumulated in said present series of copying operations under running conditions as said count number of copy sheets that is accumulated in said present series of copying operations after starting said recycled use of said toner, wherein said computing means is adapted to compute said acceptable count number of copy sheets that can be utilized in image forming in a forthcoming series of copying operation under running conditions until immediately before said threshold for the emergence of picture image anomalies caused by contaminants in said toner in said toner recycling means.

20. An image forming means comprising:

at least image bearing means;

exposure means for forming an electrostatic latent image on said image bearing means;

developing means for forming a toner image by developing said latent image using toner on said image bearing means;

transfer means for transferring said toner image to a substrate;

cleaning means for cleaning said image bearing means by removing said toner material remaining on said image bearing means following the transfer;

toner recycling means for returning said toner removed from said image bearing means to said developing means;

paper dust measuring means provided in a paper dust removal means for measuring an amount of paper dust collected in said paper dust removal means;

dust amount estimating means for estimating an amount of paper dust included in said toner recovered by said cleaning means based on an estimation;

computing means for computing an acceptable count number of copy sheets that can be utilized in image forming in a forthcoming series of copying operations for a period of time from a start of a recycled use of said toner until immediately before a threshold for emergence of picture image anomalies caused by contaminants in said toner in said toner recycling means, based on results on the estimated amount of paper dust by said dust amount estimating means; and selection means for selectably switching between a toner recycling mode and toner non-recycling mode for said image forming means, based on said acceptable count number of copy sheets computed by said computing means.

* * * * *